United States Patent [19]

Yamagishi et al.

[11] Patent Number: 4,995,568

[45] Date of Patent: Feb. 26, 1991

[54] WIRE TERMINAL ATTACHING STRUCTURE OF A DRIVEN ROTARY BODY

[75] Inventors: Jun Yamagishi; Hiromitsu Nishikawa; Akihiro Takeda, all of Yokohama, Japan

[73] Assignee: Ohi Seisakusho Co., Ltd., Yokohama, Japan

[21] Appl. No.: 133,610

[22] Filed: Dec. 16, 1987

[30] Foreign Application Priority Data

Jan. 16, 1987 [JP] Japan ..... 62-003600

[51] Int. Cl.[5] ..... B65H 75/28

[52] U.S. Cl. ..... 242/125.1; 242/74; 49/352

[58] Field of Search ..... 242/74, 125.1, 125.2, 242/125.3; 49/352, 349

[56] References Cited

U.S. PATENT DOCUMENTS

| | | | |
|---|---|---|---|
| 4,194,605 | 3/1980 | Sessa | 49/352 X |
| 4,662,236 | 5/1987 | Kobayashi | 49/352 X |
| 4,663,886 | 5/1987 | Nakamura et al. | 49/352 X |
| 4,753,125 | 6/1988 | Fukumoto et al. | 49/352 X |

FOREIGN PATENT DOCUMENTS

| | | |
|---|---|---|
| 164121 | 11/1985 | European Pat. Off. . |
| 61-185888 | 11/1986 | Japan . |
| 1197879 | 7/1970 | United Kingdom . |

*Primary Examiner*—Katherine A. Matecki

*Attorney, Agent, or Firm*—Foley & Lardner, Schwartz, Jeffery, Schwaab, Mack, Blumenthal & Evans

[57] ABSTRACT

A wire terminal attaching structure of a driven rotary body comprises a drive device for driving the driven rotary body, a cover for rotatably supporting and surrounding the driven rotary body, and an engaging device formed in the driven rotary body and engagable with a terminal portion of a wire. The engaging device has a guide groove connected to a circumferential groove formed in the driven rotary body and receiving the wire, and an inserted port communicated with the guide groove and receiving the terminal portion of the wire. The cover has a cut-out portion for exposing the guide groove and the inserted port. The cover comprises a base plate rotatably supporting the driven rotary body and a cover for surrounding the driven rotary body and having the cut-out portion. The wire is connected to an auxiliary member operated by the movement of the wire. The inserted port is disposed along the axial direction of the driven rotary body.

19 Claims, 5 Drawing Sheets

WIRE TERMINAL ATTACHING STRUCTURE OF A DRIVEN ROTARY BODY

The present invention relates to a wire terminal attaching structure of a driven rotary body such as a wire drum.

BACKGROUND OF THE INVENTION

In a conventional wire terminal attaching structure, as shown in FIG. 1, a wire 105 for operating an auxiliary part such as a window regulator, etc., is connected to a carrier plate 103 vertically and movably attached to a guide rail 101. The wire 105 is disposed along the guide rail 101 and extends through guide tubes 109 via upper and lower wire guide portions 107, and is wound around circumferential grooves 113 on a drum 111. When one end portion of the wire 105 is wound by the normal or reverse rotation of the drum 111, the other end portion of the wire 105 is unwound.

The wire 105 is attached onto the drum 111 in a state in which the wire 105 is wound around the drum 111, and is wound and unwound in the normal and reverse rotations of the drum 111.

A cover 117 is attached to a base plate 115 and surrounds the wire 105 to prevent the wire 105 from jumping off the circumferential grooves 113 on the drum 111 when the wire 105 is wound and unwound in the normal and reverse rotations of the drum 111.

Accordingly, the wire 105 is attached onto the drum 111 in advance, and a flange 119 of the cover 117 is then fixed to the base plate 115 so that the cover 17 is assembled in a state in which the wire 105 is tensioned, thereby reducing the operability. Further, after the assembly of the cover 117, the cover 117 must be detached when the wire 105 is replaced by a new one so that the operation is very complicated. As shown by the chain line in FIG. 1, the cover 117 must be disposed to be separated from the base plate 115 so that the cover 117 is attached to the base plate 115 in an assembly line, which is an after-attaching type, thereby increasing the number of control operations and reducing the operation efficiency.

SUMMARY OF THE INVENTION

To overcome the problems mentioned above, an object of the present invention is to provide a wire terminal attaching structure of a driven rotary body for enabling a wire to be disposed after the assembly and reducing the number of control operations and improving the operation efficiency.

With the above object in view, the present invention resides in a wire terminal attaching structure comprising a driven rotary body surrounded by a base plate and a cover and driven by drive means. The driven rotary body has an engaging portion engagable with a terminal portion extended from a wire connected to a guide member for guiding the movement of the wire. The engaging portion of the driven rotary body has a guide groove connected to a circumferential groove, and an inserted port communicated with the guide groove and disposed along the axial direction of the driven rotary body. The guide groove and the inserted port are exposed by cutting a portion of the cover.

In accordance with the structure of the present invention mentioned above, when the wire is attached onto the engaging portion of the driven rotary body, the terminal portion of the wire is positioned with respect to the exposed inserted port and is thereafter inserted into the inserted port. At this time, the terminal portion of the wire is engaged with the engaging portion after the insertion into the inserted port, and simultaneously the wire is adjacent to the bottom of the circumferential groove from the guide grooves. Accordingly, when the driven rotary body is rotated, the wire can become in an attaching state in which the wire is wound around the circumferential groove. In this attaching state of the wire, the terminal portion of the wire is not moved out of the inserted port since the wire contacts an edge of the guide groove. Further, when the wire is unwound, the wire does not jump off the circumferential groove since the wire is restricted by the cover. Further, the wire can be replaced by a new one by detaching the wire terminal portion from the inserted port.

BRIEF DESCRIPTION OF THE DRAWINGS

The present invention will be more apparent from the following description of the preferred embodiments thereof in conjunction with the accompanying drawings in which.

DETAILED DESCRIPTION OF THE PREFERRED EMBODIMENTS

The preferred embodiments of the present invention will next be described with reference to the drawings.

Figure 1:
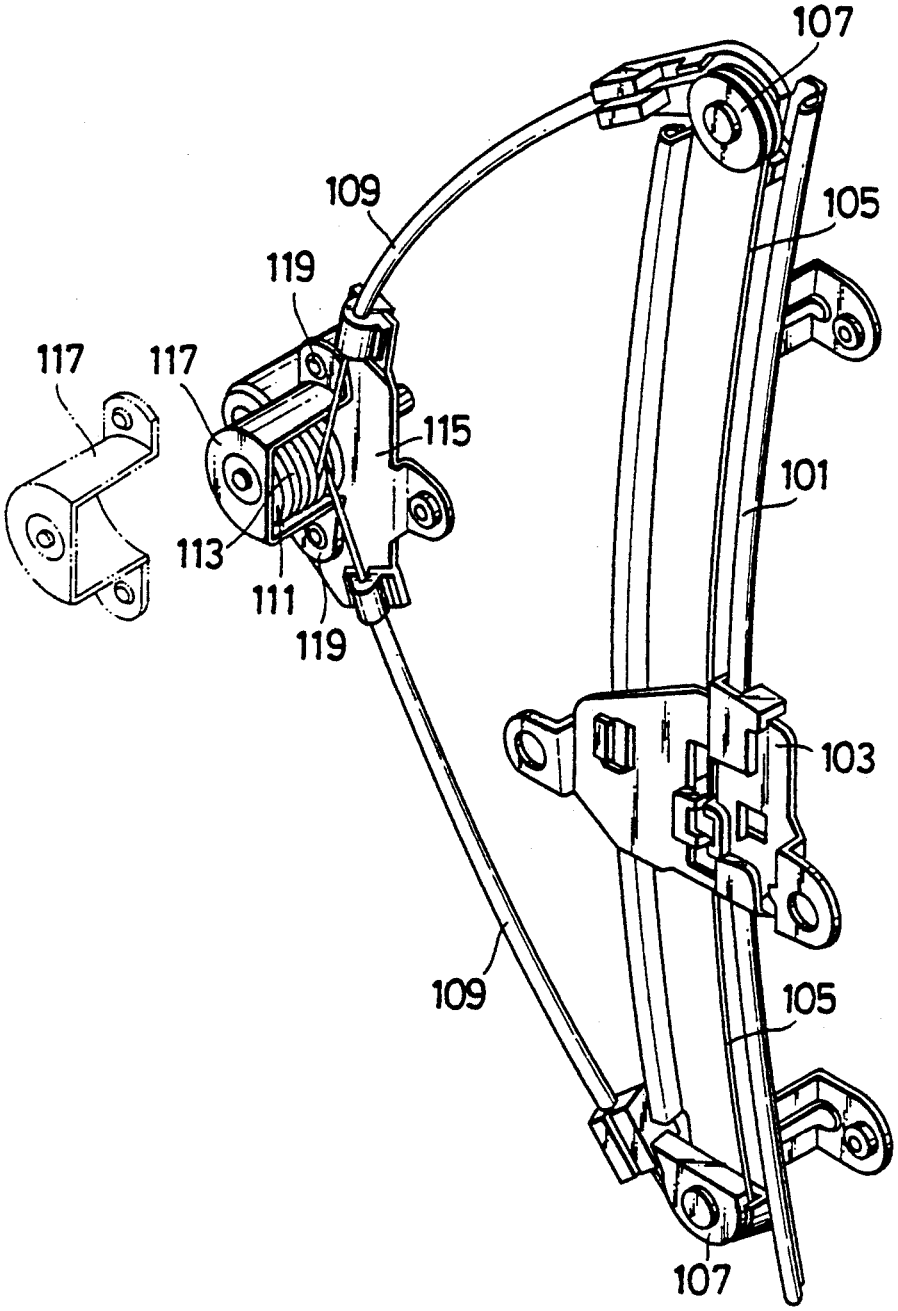
FIG. 1 PRIOR ART
FIG. 1 is a perspective view showing a conventional window regulator.
Figure 2:
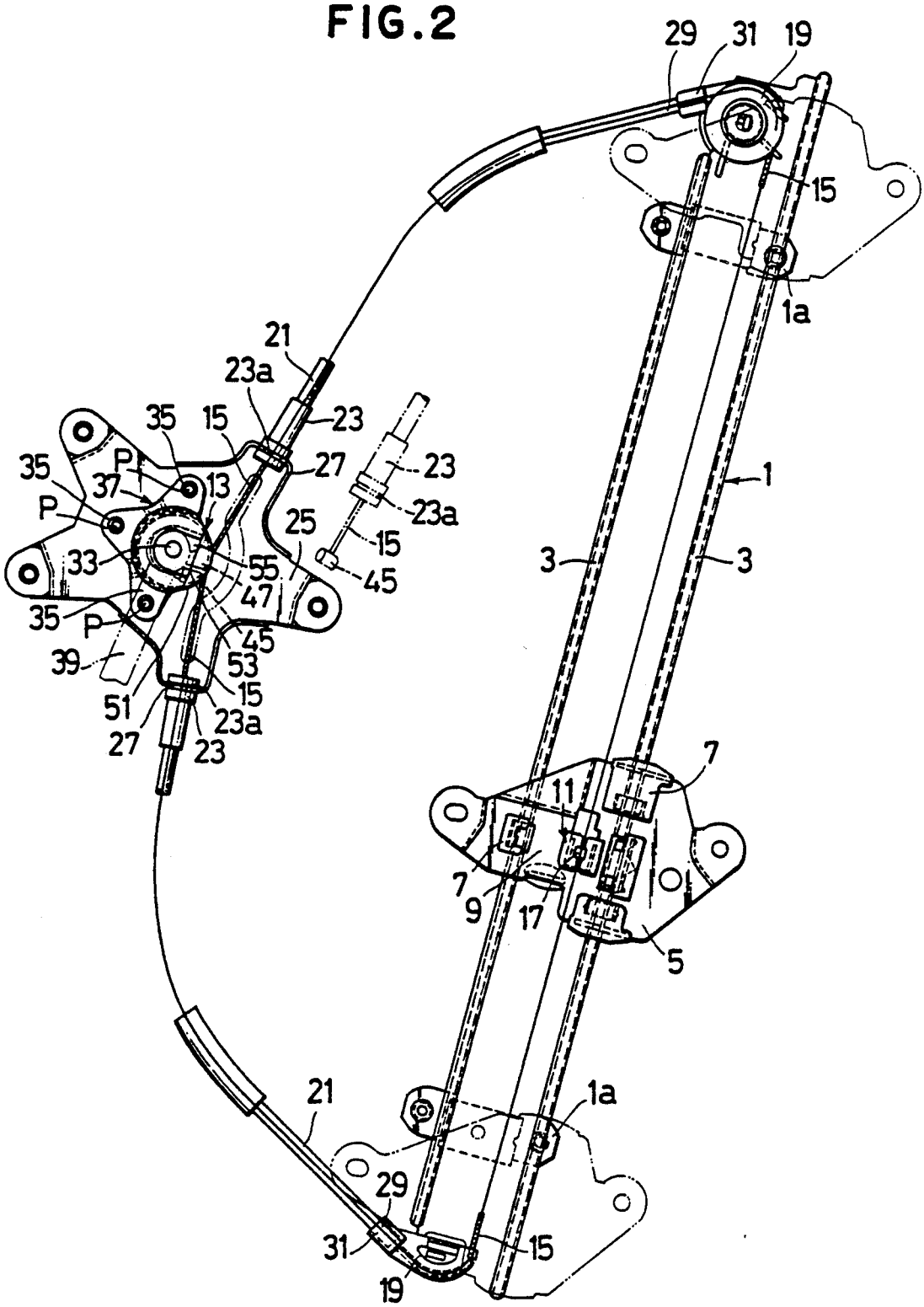
FIG. 2 is a view showing an entire window regulator to which the present invention is applied as an embodiment.

In FIG. 2, a wire type window regulator constitutes a guide member attached to an unillustrated inner panel of a door through upper and lower brackets 1*a*. Support members 7 of a carrier plate 5 to which a window panel made of glass is attached are fitted to rail portions 3 of the guide member 1.

The support members 7 are made of synthetic resin and are projected from a plate body 9, and are fitted to and engaged with the rail portions 3 so that the carrier plate 5 can slide along the guide member 1 in the upper and lower directions. A wire engaging portion 11 is formed in the carrier plate 5 which is engaged with a stopper 17 of a wire 15 unwound from a driven rotary body 13 such as a wire drum.

The wire 15 extending from upper and lower ends of the stopper 17 is disposed along the longitudinal direction of the guide member 1, and extends through guide tubes 21 via wire guide portions 19(one of which is a guide pulley) disposed at both ends of the guide member 1, and is then wound around the driven rotary body 13. An engaging recessed portion 23*a* of a terminal portion 23 of one of the respective guide tubes 21 is engaged with and disengaged from an attaching portion 27 extended from a base plate 25, and the other terminal portion 29 is fixed to an attaching portion 31 of the guide member 1.

The driven rotary body 13 is mounted on a drive shaft 33 manually rotatable in the normal and reverse directions, and is surrounded by a cover 37 having a flange portion 35 fixed to the base plate 25 by caulking, etc. The drive shaft 33 is rotatably supported by the cover 37 at one end thereof, and is rotatably supported by the base plate 25 at the other end thereof. An end portion of the drive shaft 33 is projected through the base plate 25 and is attached to a drive device 39 such as an operating handle. The drive device 39 is manually driven, but may be automatically driven by a drive motor, etc.

Figure 3:
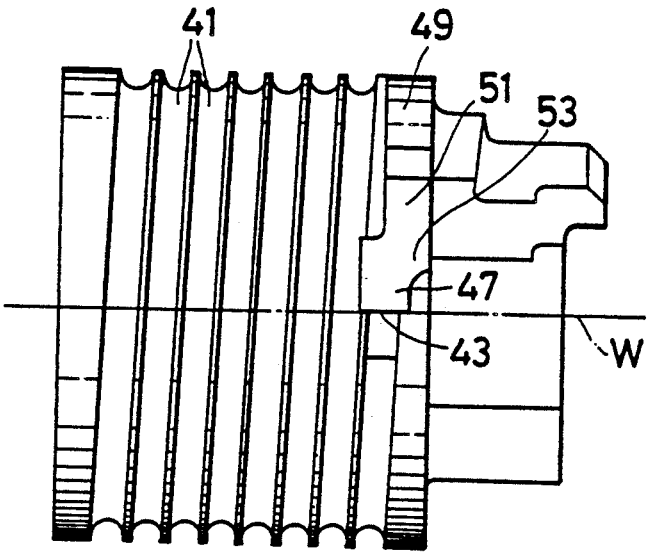
FIG. 3 is a side view showing a driven rotary body of a drum type.

As shown in FIG. 3, a spiral circumferential groove 41 is formed on the circumferential surface of the driven rotary body 13, and an engaging portion 47 engaged with and disengaged from a terminal portion 45 of the wire 15 is disposed in a groove bottom 43 at each of both ends of the circumferential groove 41. The terminal portion 45 of the wire 15 is cylindrically formed as shown in FIG. 2, and the wire terminal is integrally connected to the circumferential surface of the cylindrical terminal portion 45.

Figure 4:
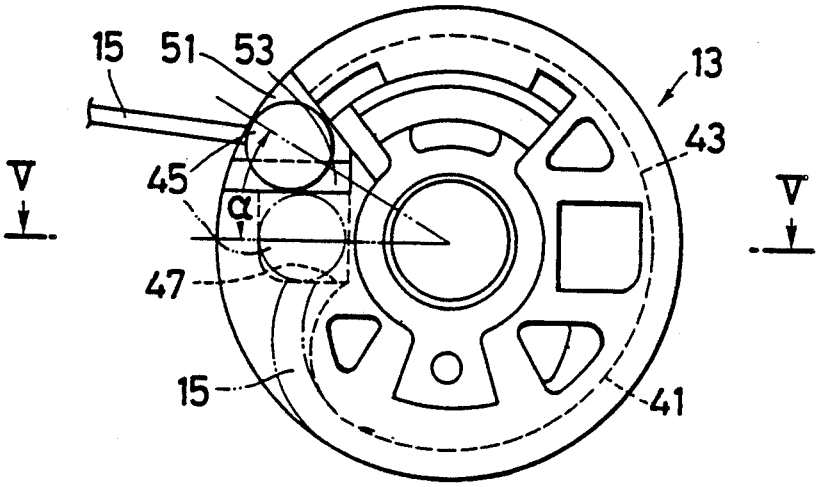
FIG. 4 is a front view of the driven rotary body of FIG. 3.
Figure 5:
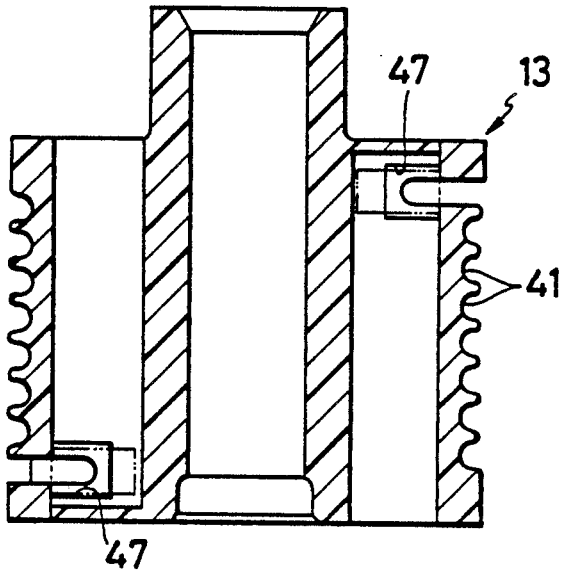
FIG. 5 is a sectional view taken along Line V—V of FIG. 4.
Figure 6:
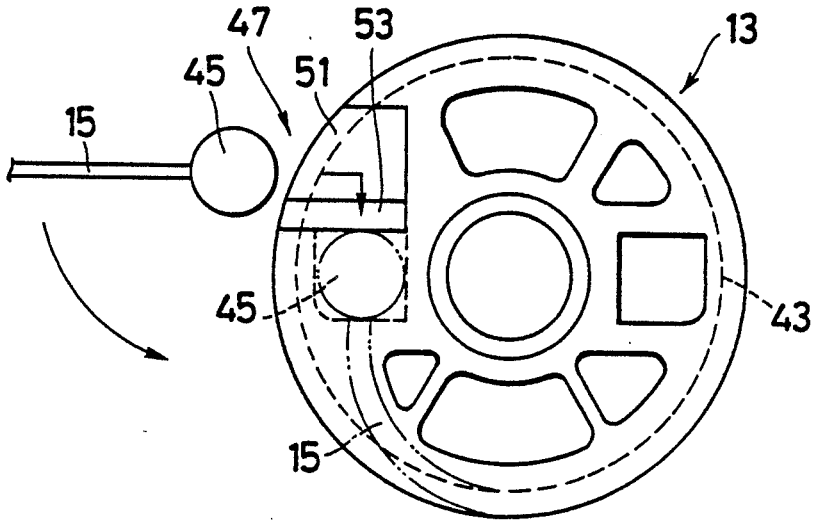
FIG. 6 is a rear view of the driven rotary body of FIG. 3.

As shown in FIGS. 3 to 6, a guide groove 51 and an insertion port 53 are disposed in the engaging portion 47 of the driven rotary body 13. The guide groove 51 is formed by cutting the driven rotary body 13 from a circumferential edge 49 to the groove bottom 43 of the circumferential groove 41. The insertion port 53 is disposed along a radial direction of the driven rotary body 13 and is communicated with the guide groove 51. The insertion port 53 and the guide groove 51 are formed to have sizes slightly greater than the diameter of the terminal portion 45 of the wire 15, and are dislocated by an angle $\alpha$ as shown in FIG. 4. The guide groove 51 is set to have the same diameter as the one of the insertion port 53.

The insertion port 53 and the guide groove 51 are disposed in alignment with a cut-out portion 55 of the cover 37 to secure an exposed state thereof, and are exposed by the cut-out portion 55 which exposes a portion of the axial surface of body 13. The insertion port 53 and the guide groove 51 disposed on the side opposite to the side of the base plate 25 have a shape for enabling the insertion of the wire from a direction perpendicular to the axial W direction since the insertion is interrupted by the base plate 25.

In the wire terminal attaching structure constructed above, when the wire 15 is attached onto the engaging portion 47 of the driven rotary body 13, the wire 15 engaged with the wire engaging portion 11 of the carrier plate 5 is disposed along the guide member 1, and then extends through the guide tubes 21. Next, a terminal portion 45 of the wire 15 is insertion into the inserted port 53 of the engaging portion 47 of the driven rotary body 13 adjacent onto the side of the base plate 25. Thus, the terminal portion 45 is engaged with the engaging portion 47, and the wire 15 is in an attaching state in which the wire 15 contacts the groove bottom 43 of the circumferential groove 41. Accordingly, after the wire 15 has been wound around the circumferential groove 41 to the uppermost or lowermost state of the carrier plate 5, the engaging recessed portion **23*a* of the terminal portion 23 of each of the guide tubes 21 is engaged with the attaching portion 27 of the base plate 25**, thereby completing the half of the assembly.

Next, the other engaging portion 47 is disposed in alignment with the cut-out portion 55, and the terminal portion 45 of the wire 15 on the upper side is positioned with respect to the insertion port 53 and is inserted into the insertion port 53. Thus, the wire terminal portion 45 is engaged with the engaging portion 47, and the wire 15 is in an attaching state in which the wire contacts the groove bottom 43 of the circumferential groove 41. Next, the engaging recessed portion **23*a* of the terminal portion 23 of the guide tube 21 is engaged with the attaching portion 27 of the base plate 25, thereby completing the assembly. In the completion of the assembly, the terminal portion 45 of the wire 15 contacts an end edge of the guide groove 51 so that the wire terminal portion 45 does not jump off the groove 51 along the axial W direction. The wire 15 also does not jump off the circumferential groove 41 since the wire is restricted by the cover 37**.

Accordingly, when the driven rotary body 13 is rotated in the normal or reverse direction, one end of the wire 15 is smoothly wound around the circumferential groove 41, and the other end of the wire 15 is smoothly unwound from the circumferential groove 41. As a result, the carrier plate 5 can be moved upwards and downwards.

When the wire 15 is replaced by a new one, the engaging portion 47 on the side of the cover 37 is aligned with the cut-out portion 55, and the terminal portion 45 of the wire 15 is detached from the insertion port 53. Next, after the wire 15 wound around the circumferential groove 41 has been completely unwound, the other terminal portion 45 of the wire 15 is detached from the other inserted port 53, and a procedure reverse to the above procedure is thereafter performed, thereby attaching the new wire 15.

Figure 7:
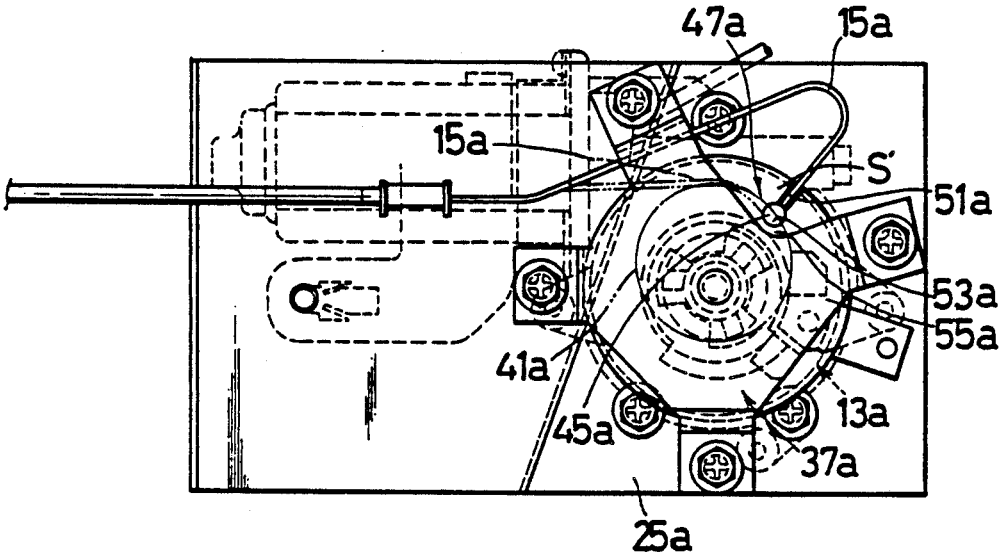
FIG. 7 is a plan view showing a driven rotary body of a pulley type.
Figure 8:
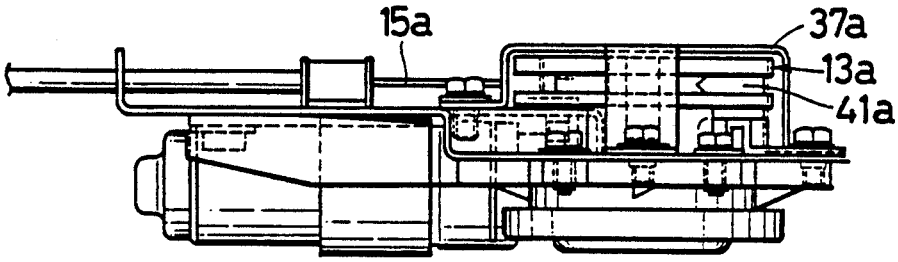
FIG. 8 is a side view of the driven rotary body of FIG. 7.

FIGS. 7 and 8 show a driven rotary body for operating an unillustrated auxiliary device. The driven rotary body is of a pulley type and comprises an engaging portion **47*a* formed on the side of a cut-out portion 55*a* of a cover 37*a* and composed of a guide groove 51*a* and an insertion port 53*a*. The driven rotary body 13*a* can be rotated only in the wound direction of the wire. The guide groove 51*a* is radially disposed from a circumferential edge of the driven rotary body 13*a* toward the axis thereof, and the width of the guide groove 51*a* is set to have a diameter slightly greater than the diameter of the wire 15*a*. The insertion port 53*a* is disposed at the inner end of the guide groove 51*a* along the axial direction of the driven rotary body 13*a*. The insertion port 53*a* is set to have a diameter slightly greater than that of a terminal portion 45*a* of the wire 15*a***.

When the wire **15*a* is assemblied in the driven rotary body 13*a* in a state in which the cover 37*a* is fixed to a base plate 25*a*, the wire 15*a* is flexed and engaged with the guide groove 51*a* of the engaging portion 47*a* placed in the cut-out portion 55*a* of the cover 37*a*, as shown by the solid line of FIG. 7. Further, the terminal portion 45*a* of the wire 15*a* is fitted into the insertion port 53*a*, and the wire 15*a* is wound around a circumferential groove 41*a*. In this state, the wire 15*a* contacts an end edge S' of the guide groove 51*a* so that the terminal portion 45*a* is not moved out of the insertion port 53*a***.

Accordingly, the auxiliary device can be operated by winding the wire **15*a* by the rotation of the driven rotary body 13*a*. After the assembly of the wire 15*a*, the wire 15*a* can be detached in a state in which the engaging portion 47*a* is aligned with the cut-out portion 55*a*, similar to the case of the driven rotary body 13** of the wire drum type mentioned above.

As mentioned above, in a wire terminal attaching structure of a driven rotary body in the present invention, a wire can be easily replaced by a new one since it is possible to attach the wire after the assembly. Further, since a cover can be attached to a base plate in advance together with the driven rotary body, thereby improving the operability and reducing the number of control operations with respect to parts.

What is claimed is:

1. A device for controlling a wire of a wire-operated apparatus, comprising:

a cylindrically-shaped rotary body for controlling the motion of the wire, the rotary body having a first and second end;

a base plate for rotatably supporting the first end of the rotary body;

engaging means formed in the rotary body and engageable with a terminal of the wire, the engaging means having a guide groove communicating with a circumferential groove formed in the rotary body for receiving the wire, and an insertion port communicating with the guide groove for receiving the terminal of the wire; and a cover for covering the rotary body and rotatably supporting the second end of the rotary body, the cover being assembled to the base plate and having cut-out portion which exposes the guide groove and the insertion port to allow the wire and the terminal to be inserted through the guide groove for attachment to the rotary body after the cover has been assembled to the base plate.

2. The device of claim 1, wherein the guide groove and the insertion port are formed at the second end of the rotary body along a single substantially radial line thereof to allow the terminal to be inserted into the insertion port in a direction parallel to the axis of the rotary body.

3. The device of claim 2, wherein the circumferential groove is formed as a spiral groove.

4. The device of claim 3, wherein both ends of the wire are attached by terminals to the rotary body.

5. The device of claim 4, further comprising means for driving the rotary body.

6. The device of claim 1, wherein both the guide groove and the insertion port have dimensions slightly larger than the corresponding dimensions of the terminal and are formed along separate substantially radial lines to allow the terminal to be inserted through the guide groove and into the insertion port along directions substantially perpendicular to the axis of the rotary body.

7. The device of claim 6, wherein the circumferential groove is formed as a spiral groove

8. The device of claim 7, wherein both ends of the wire are attached by terminals to the rotary body.

9. The device of claim 8, further comprising means for driving the rotary body.

10. The device of claim 1, wherein said cut-out portion exposes a portion of an axial surface of said second end of said rotary body.

11. A device for controlling a wire of a wire-operated apparatus, comprising:

a cylindrically-shaped rotary body for controlling the motion of the wire, the rotary body having a first and second end;

a base plate for rotatably supporting the first end of the rotary body;

engaging means formed in the rotary body and engageable with a terminal of the wire, the engaging means having a guide groove communicating with a circumferential groove formed in the rotary body for receiving the wire, and an insertion port communicating with the guide groove for receiving the terminal of the wire; and a cover for covering the rotary body and rotatable supporting the second end of the rotary body, the cover being assembled to the base plate and having a cut-out portion which exposes the guide groove and the insertion port to allow the wire and the terminal to be attached to the rotary body after the cover has been assembled to the base plate, wherein said cut-out portion exposes a portion of an axial surface of said second end of said rotary body.

12. The device of claim 11, wherein the guide groove and the insertion port are formed at the second end of the rotary body along a single substantially radial line thereof to allow the terminal to be inserted into the insertion port in a directional parallel to the axis of the rotary body.

13. The device of claim 12, wherein the circumferential groove is formed as a spiral groove.

14. The device of claim 13, wherein both ends of the wire are attached by terminals to the rotary body.

15. The device of claim 14, further comprising means for driving the rotary body.

16. The device of claim 11, wherein both the guide groove and the insertion port have dimensions slightly larger than the corresponding dimensions of the terminal and are formed along separate substantially radial lines to allow the terminal to be inserted through the guide groove and into the insertion port along directions substantially perpendicular to the axis of the rotary body.

17. The device of claim 16, wherein the circumferential groove is formed as a spiral groove.

18. The device of claim 17, wherein both ends of the wire are attached by terminals to the rotary body.

19. The device of claim 18, further comprising means for driving the rotary body.

* * * * *